United States Patent [19]

Wilson

[11] Patent Number: 5,049,022

[45] Date of Patent: Sep. 17, 1991

[54] PARKING STRUCTURE

[76] Inventor: Jack S. Wilson, 6758 - 203 Street, R.R. 4, Langley, British Columbia, Canada, V3A 4P7

[21] Appl. No.: 305,855

[22] Filed: Feb. 3, 1989

[30] Foreign Application Priority Data

Feb. 3, 1988 [CA] Canada ..... 558013

[51] Int. Cl.[5] ..... E04H 6/00

[52] U.S. Cl. ..... 414/253; 187/20; 414/254

[58] Field of Search ..... 414/253-262, 414/280, 282, 662, 663; 410/30; 187/17, 20

[56] References Cited

U.S. PATENT DOCUMENTS

| | | | |
|---|---|---|---|
| 2,598,750 | 6/1952 | Bargehr | 414/253 |
| 2,647,647 | 8/1953 | Alimanestiano | 414/254 |
| 2,838,186 | 6/1958 | Alimanestiano | 414/254 |
| 2,899,087 | 8/1959 | Jacobsen | 414/254 |
| 2,901,129 | 8/1959 | Sanders | 414/254 |
| 2,915,204 | 12/1959 | Alimanestiano | 414/254 |
| 3,063,579 | 11/1962 | Alimanestiano | 414/254 |
| 3,120,880 | 2/1964 | Joseph | 187/17 |
| 3,498,415 | 3/1970 | Wright | 187/17 |
| 4,807,723 | 2/1989 | Salmon et al. | 187/20 |
| 4,804,302 | 2/1989 | Andre | 416/30 |

FOREIGN PATENT DOCUMENTS

| | | |
|---|---|---|
| 1000987 | 6/1957 | Fed. Rep. of Germany . |
| 1127134 | 12/1956 | France . |
| 1291812 | 3/1962 | France . |

*Primary Examiner*—Ed Swinehart

*Attorney, Agent, or Firm*—Oliff & Berridge

[57] ABSTRACT

A multi-level storage or parking structure. Modular construction of the facility and its components offers portability. Vehicle delivery and pickup is achieved with a telescoping type drive and a shuttle slave mechanism used on a bi-directional shuttle. Hydraulic elevator operation allows the use of a single hydraulic drive unit to operate more than one skip or elevator which may include more than one vehicle on each elevator. Flexible fingers are mounted on the shuttle to retain the vehicle during delivery and retrieval and vehicle storage and retrieval is automatically accomplished.

4 Claims, 19 Drawing Sheets

PARKING STRUCTURE

INTRODUCTION

This invention relates to a storage parking structure and, more particularly, to a multi-level parking or storage structure with modular construction to allow portability.

BACKGROUND OF THE INVENTION

Parking a personal vehicle in large cities is a difficult task worldwide. This is so because the economics do not provide incentive for the erection of final or permanent multi-level parking structures because of land values in the downtown areas of such cities.

Generally, however, there is no absence of available locations to place parking structures. This is so because land prices or business conditions do not yet warrant a permanent building on the location. As a result, empty lots may exist and these lots are usually turned into interim parking lots having, of course, only one ground level parking area. While parking structures having multi-level parking are certainly known, these structures are intended to be permanent which is disadvantageous when economic conditions improve.

Vehicle pickup and removal systems are known which use a laterally and horizontally movable conveying system such as a movable vehicle table. Such systems, however, can only be extended a limited distance from the vehicle conveying position and involve mechanisms within the storage structure itself with the result that more complicated motion mechanisms are usually required to allow for the full movement of the vehicle from its conveying position to its delivery position.

Elevators for moving vehicles vertically a distance more than two floors are also known. Such elevators may be either hydraulically or electrically operated. If the elevator is hydraulically operated, it is raised and lowered by the use of a telescoping hydraulic cylinder which cannot extend beyond three or four stories. If the elevator is electrically operated, one electric motor is used for each elevator. Such motors are prone to control problems and are unnecessarily expensive.

SUMMARY OF THE INVENTION

According to one aspect of the invention, there is provided a modular building structure comprising at least one skip vertically movable within a skip hoist shaft, at least one drive hoist module operable to be mounted at the upper end of said skip hoist shaft, at least one bi-directional shuttle module for each skip and a plurality of storage slot modules surrounding said skip hoist shaft.

According to a further aspect of the invention, there is provided a hydraulically powered skip hoist system comprising at least two skips, a hydraulic motor for each of said skips, connections means extending between each of said skip hoist platform modules and said respective one of said hydraulic motors and a hydrostatic hydraulic pump means connected to said hydraulic motors.

According to a further aspect of the invention there is provided a bi-directional shuttle apparatus comprising a base, a middle slide mounted on said base and being movable relative thereto, an upper slide mounted on said middle slide and movable relative thereto, drive means mounted to said base and being operable to move said middle slide relative to said base and upper slide relative to said base and said upper slide.

According to yet a further aspect of the invention, there is provided a method of parking a vehicle comprising the steps of positioning a vehicle on a skip, elevating said skip and vehicle to a position adjacent a parking module and moving said vehicle from said skip to said parking module, said elevating of said skip and said movement of said vehicle being accomplished automatically.

According to yet a further aspect of the invention, there is provided a carrying platform for an article comprising a slide portion, flexible fingers rotatable about an axis and mounted on said slide, bias means to bias said flexible fingers to a first position wherein a restraining force is exerted on said article and deactuator means for moving said fingers away from said first position.

BRIEF DESCRIPTION OF THE SEVERAL VIEWS OF THE DRAWINGS

A specific embodiment of the invention will now be described, by way of example only, with the use of drawings in which:

FIG. 9 is a plan view of the skip hoist machinery utilized with the structure of FIG. 8;

FIG. 14A is a partial view of a shuttle module according to a second embodiment of the invention;

DESCRIPTION OF SPECIFIC EMBODIMENT

Figure 1A:
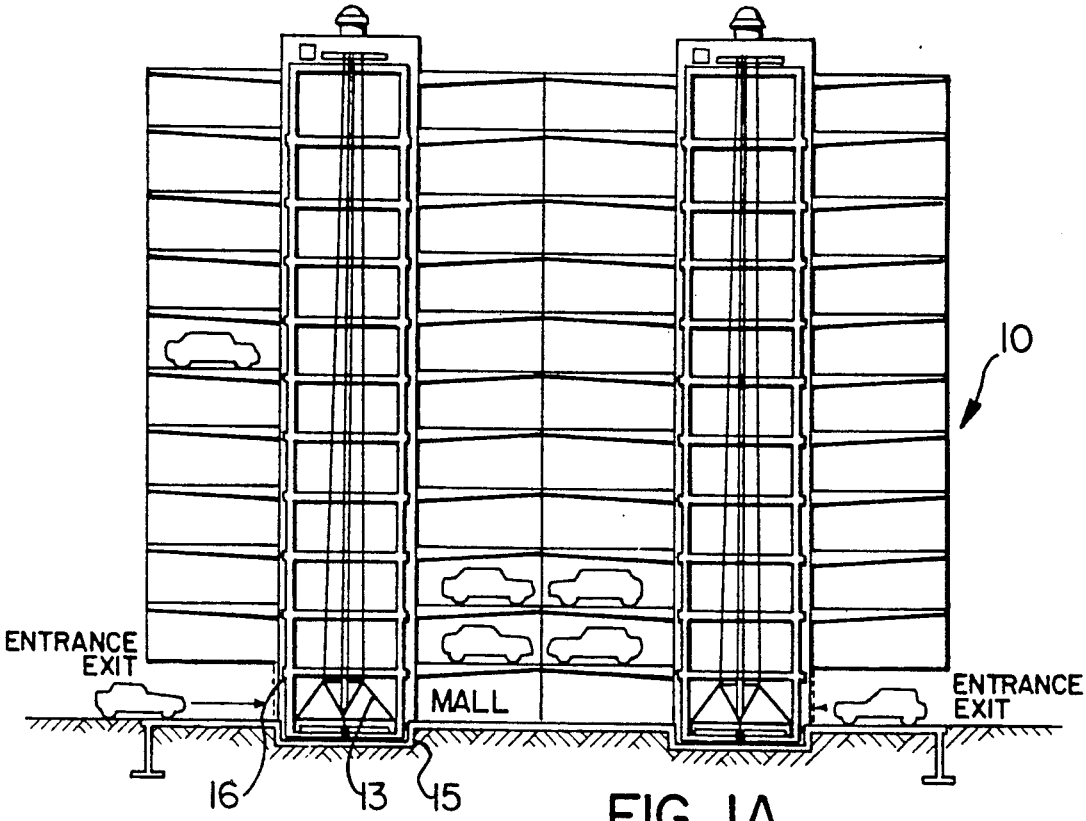
FIG. 1A is a diagrammatic elevation side view of a parking structure according to the invention.
Figure 1B:
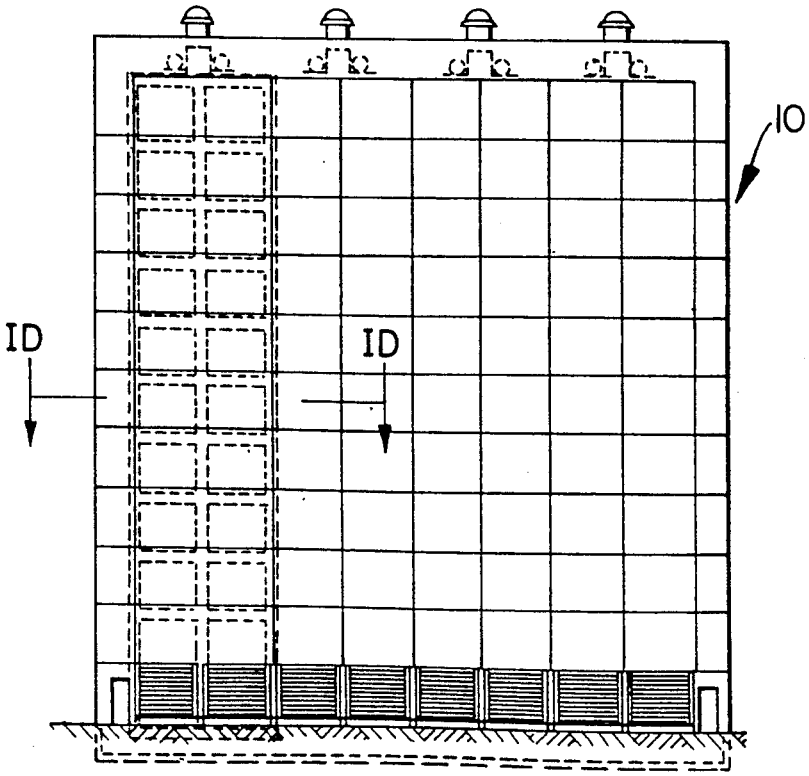
FIG. 1B is a diagrammatic elevation front view of the parking structure of FIG. 1A.
Figure 1C:
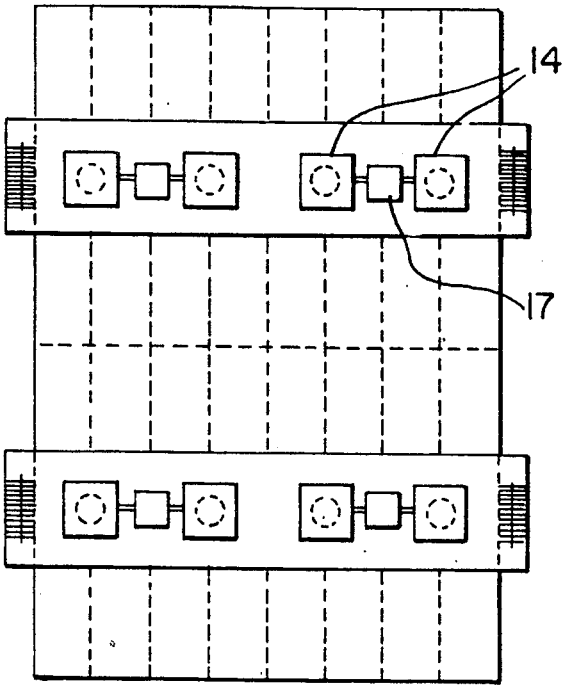
FIG. 1C is a diagrammatic plan view of the parking structure of FIG. 1A.
Figure 1D:
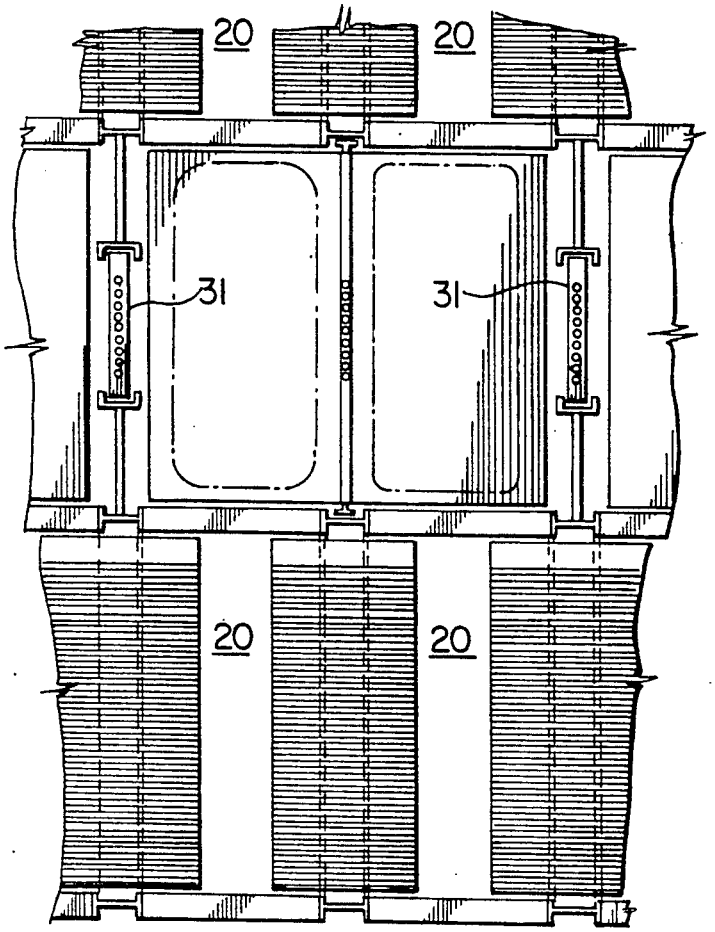
FIG. 1D is a diagrammatic plan partial view of the elevator or skip hoist shaft, a two vehicle shuttle and adjacent parking or storage slots taken along the line 1D—1D of FIG. 1B.

Referring now to the drawings, a parking structure is generally illustrated at 10 in FIG. 1A. It is constructed on a cement or concrete foundation 11 with skip and shuttle pits 15 formed in the foundation 11 to allow for movement of a plurality of skips or elevators 13.

Figure 8:
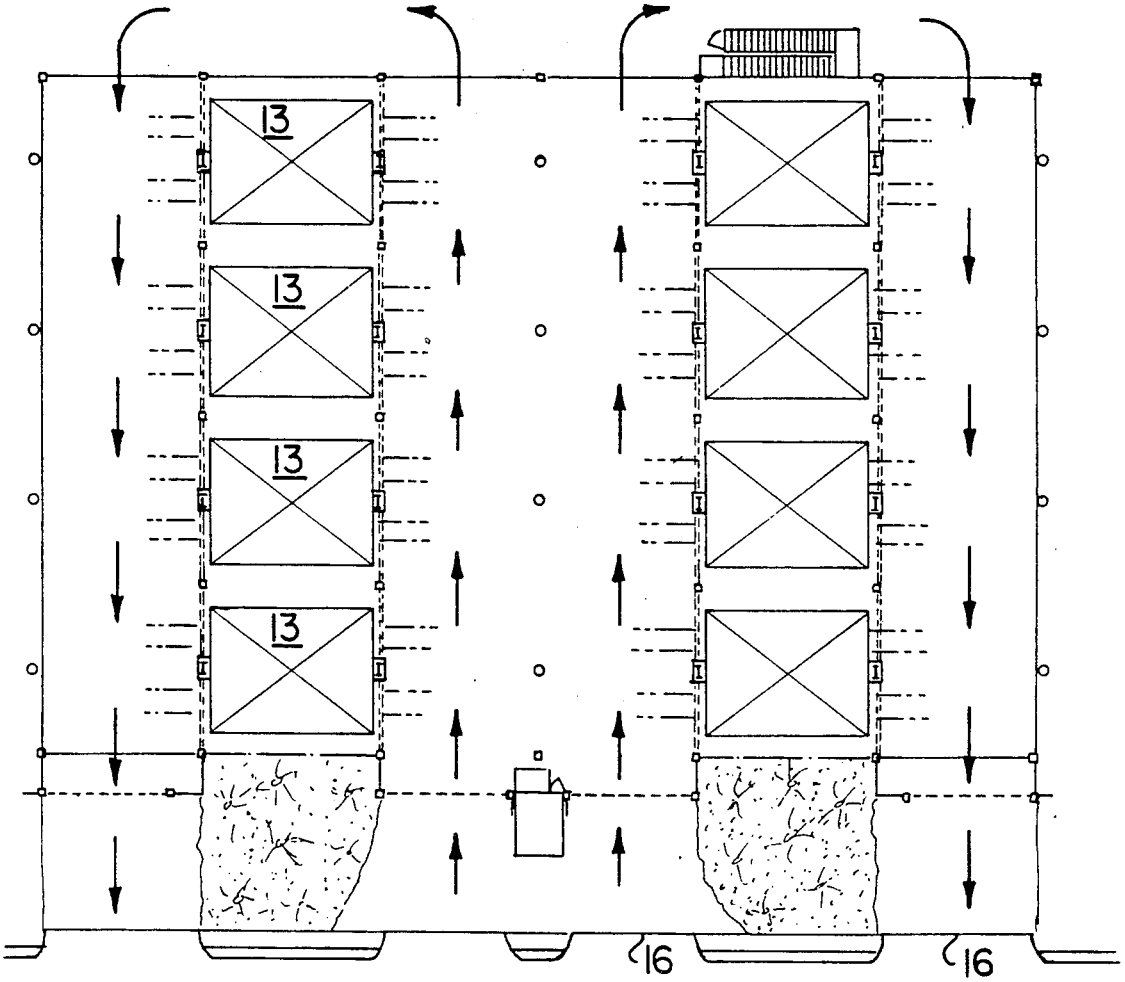
FIG. 8 is a plan view of the ground or entrance and exit floor illustrating the traffic flow in and out of the structure.
Figure 14:
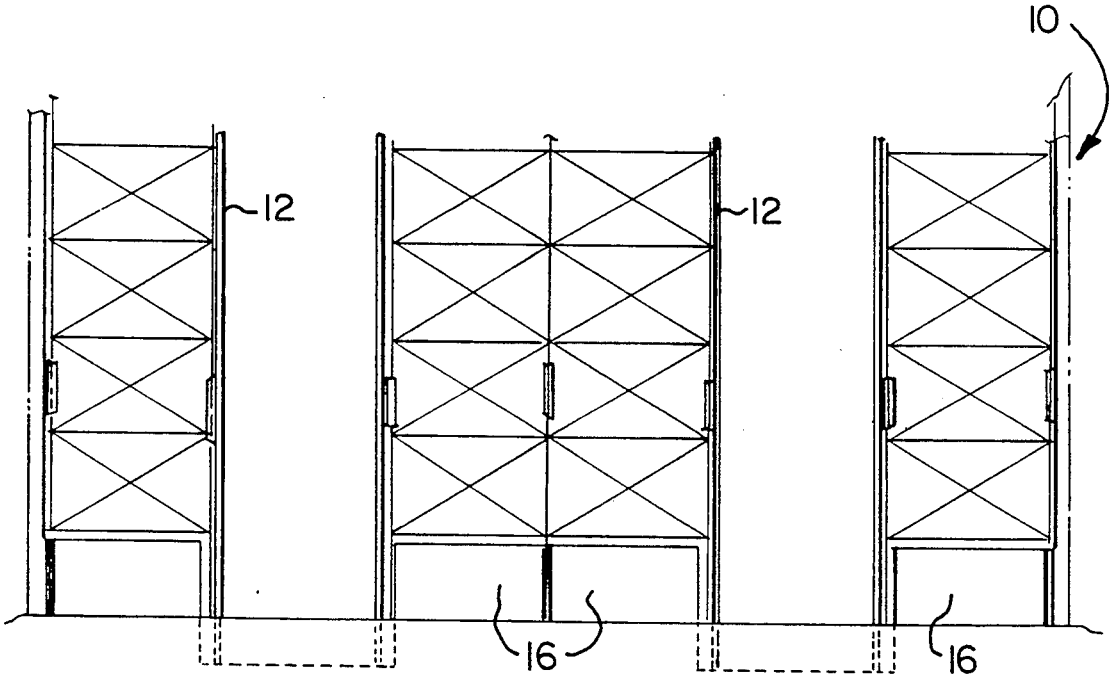
FIG. 14 is an elevation view illustrating the columns and the skip hoist guides of the parking structure.

The structure 10 is formed to allow multiple entrance and exit or access ports 16 as seen also in FIGS. 8 and 14 with reference to FIG. 8, the preferred direction of vehicle movement is given by the arrows.

Figure 6:
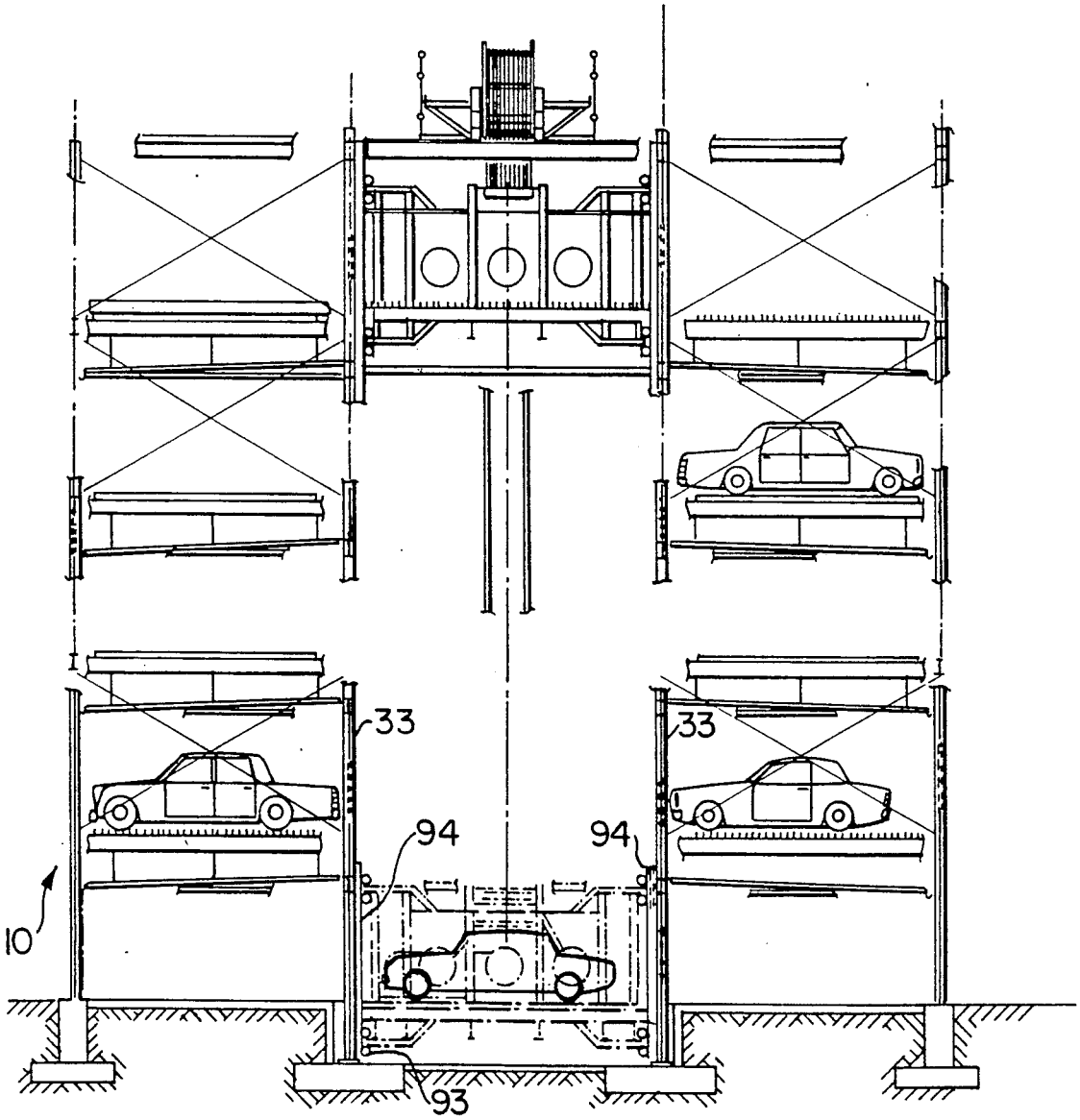
FIG. 6 is an elevation side view of the parking structure according to the invention.

As viewed in FIGS. 6 and 14, the structure 10 is constructed with a plurality of elevator or skip hoist shafts 12 extending the height of the structure 10 and of dimensions sufficient to allow vertical movement of the skips or elevators 13 which will be described in detail hereafter.

Figure 7:
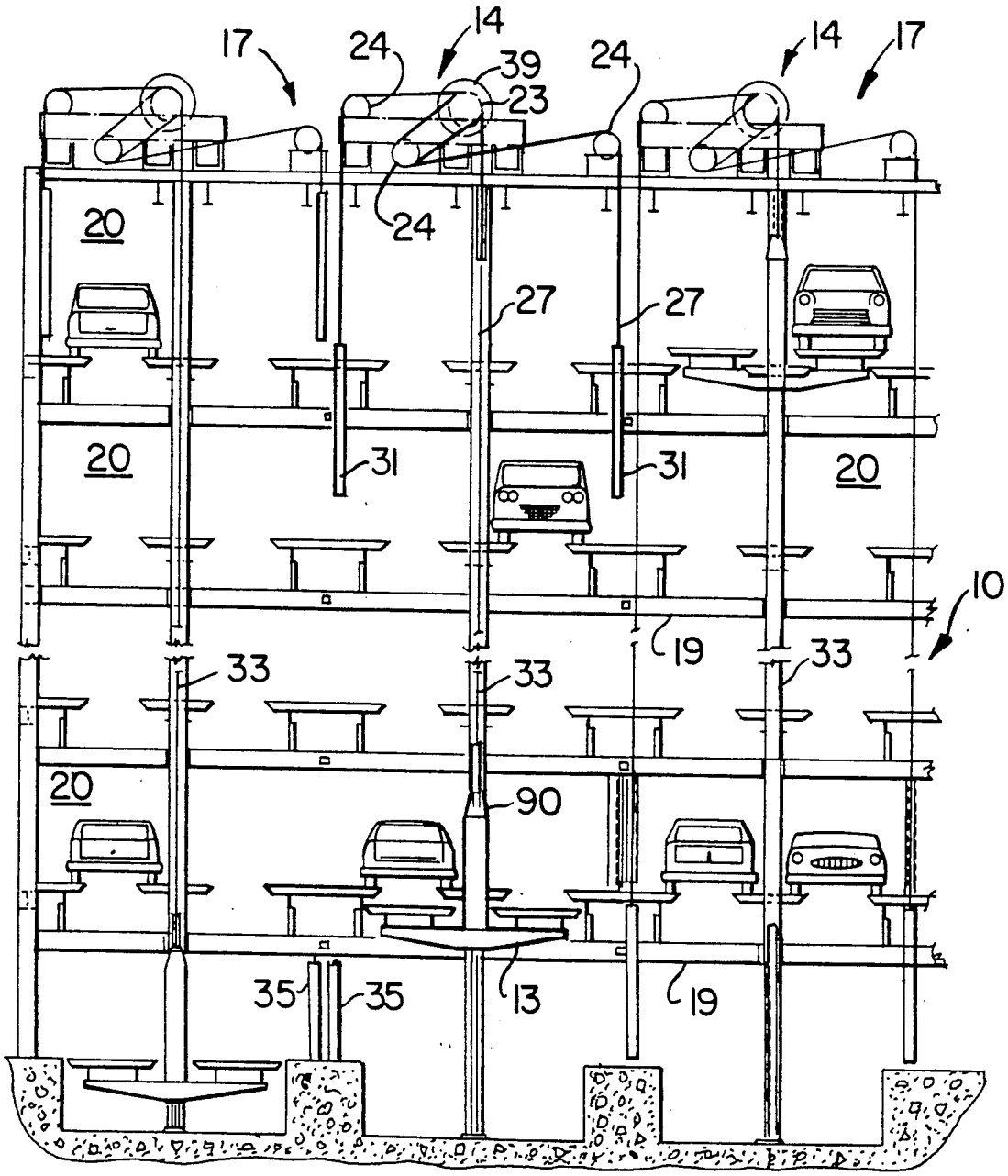
FIG. 7 is an elevation front view of the parking structure of FIG. 6.

As best seen in FIG. 7, the structure 10 is also constructed to accommodate a plurality of parking slot modules 20 described in greater detail hereafter and arranged around the elevator or skip hoist shafts 12. The structure 10 is constructed to allow the installation of a drive hoist module generally illustrated at 14 (FIGS. 3 and 7), one for each skip 13, on the top of the structure 10 as will be described in greater detail hereafter. The structure 10 similarly is designed to accommodate a plurality of power unit modules generally illustrated at 17 and described in greater detail hereafter, one for each two drive hoist modules 14.

Figure 3:
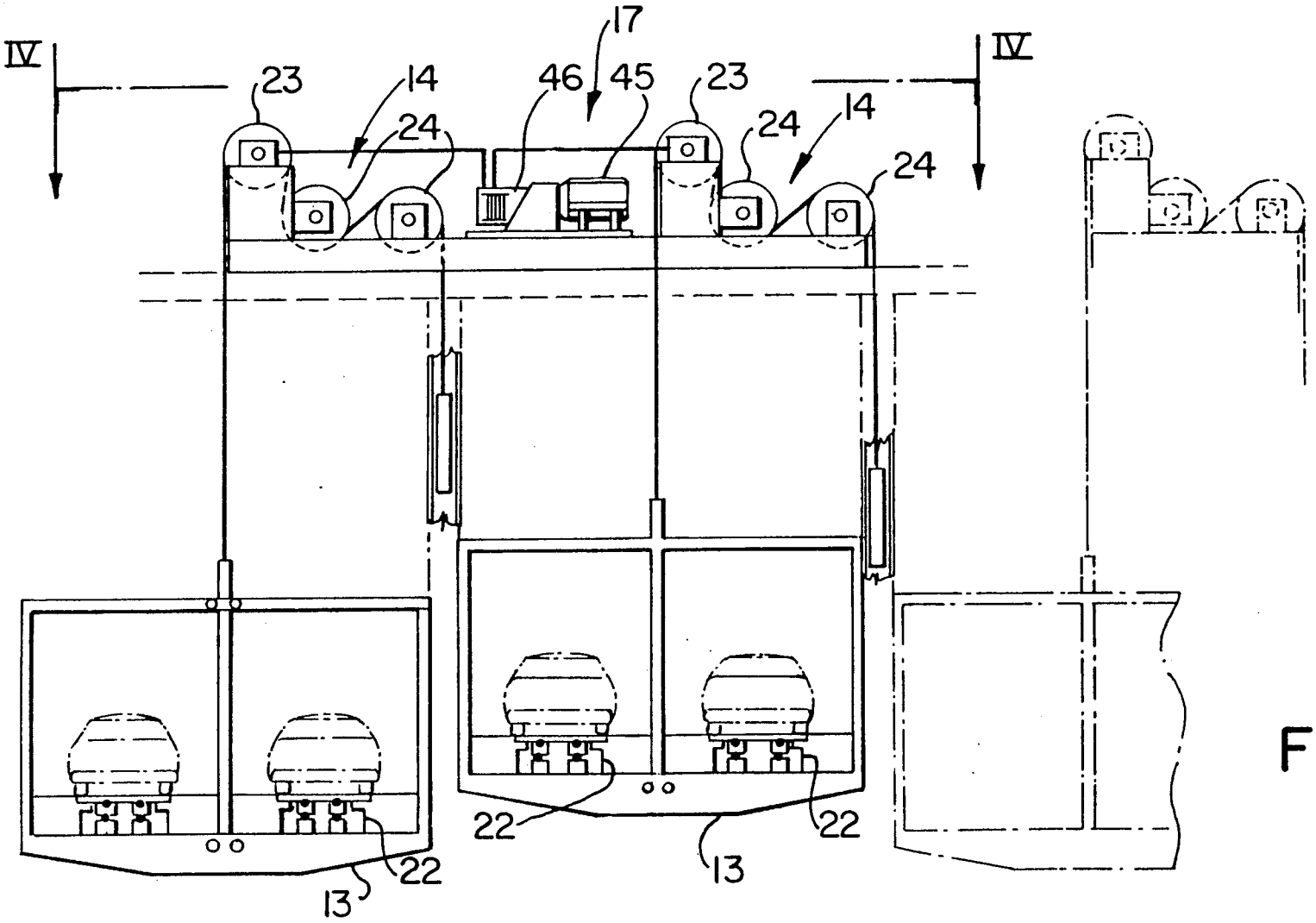
FIG. 3 is a diagrammatic side view of two independently movable skips in a first embodiment, each with respective shuttles and particularly illustrating their associated drive hoist modules.

As illustrated in FIGS. 3 and 7, each skip 13 is designed to accommodate the installation of two shuttle modules 22, each shuttle module 22 being adapted to carry one vehicle 18 and as will be described in greater detail hereafter.

The structure 10 includes vertical steel "I" beam columns 33. The uppermost beams in the column 33 are larger than the lower beams in the column 33. The sections in the columns 33 are bolted or otherwise joined together at both the web and flange areas with rectangular steel pieces as is known in the art and which is not illustrated.

Figure 2A:
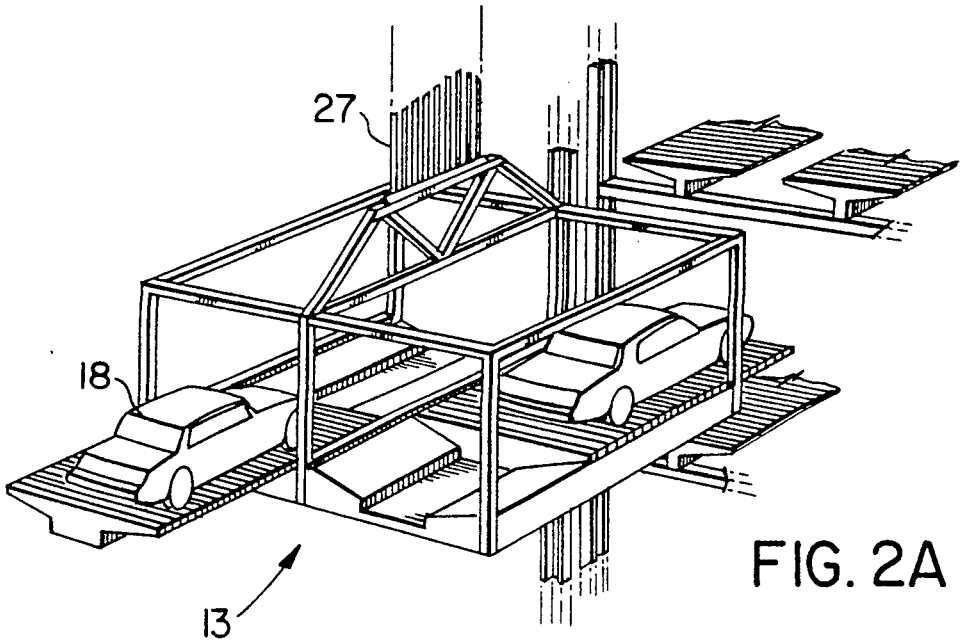
FIG. 2A is a diagrammatic isometric view of a first embodiment of a two unit skip with two shuttle modules mounted thereon.
Figure 2B:
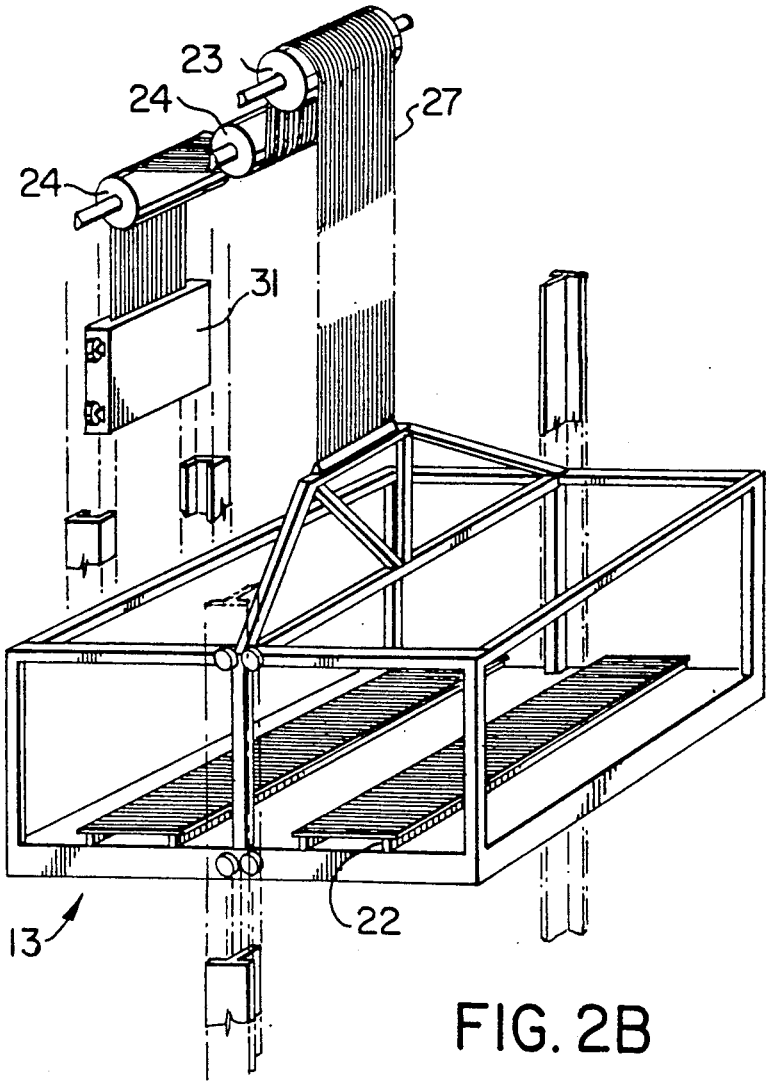
FIG. 2B is a diagrammatic isometric view of a skip according to the invention but illustrating particularly the operation and attachment of the counterweight in a first embodiment.
Figure 2C:
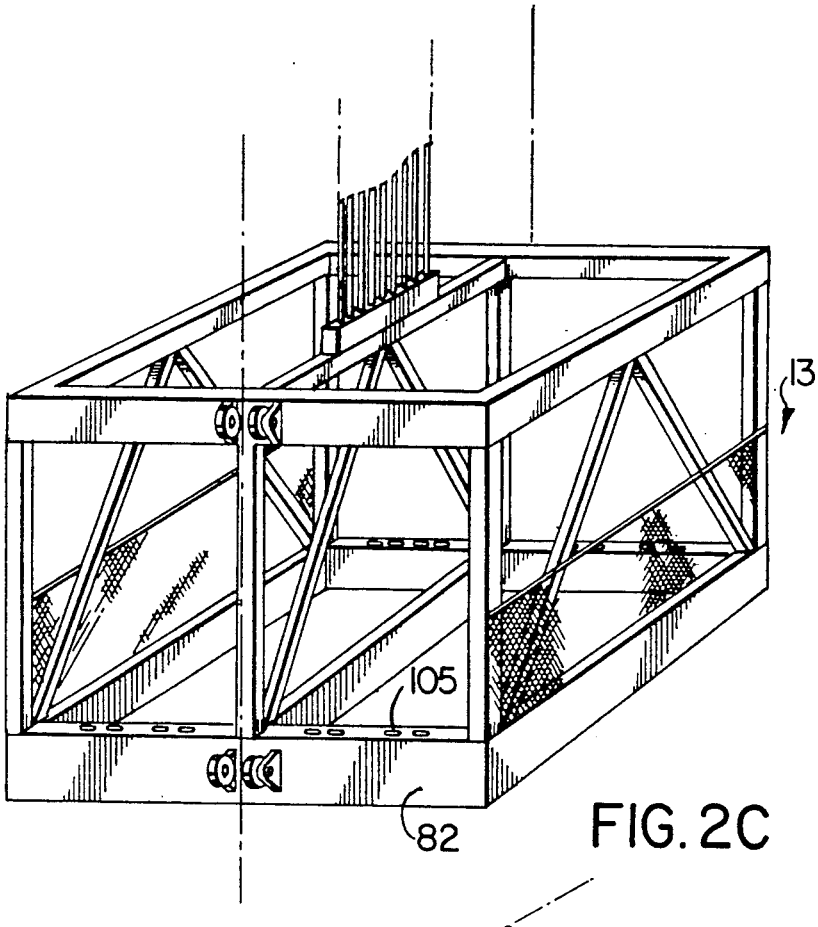
FIG. 2C is an enlarged diagrammatic isometric view of a skip according to the invention but without the shuttle modules.
Figure 2D:
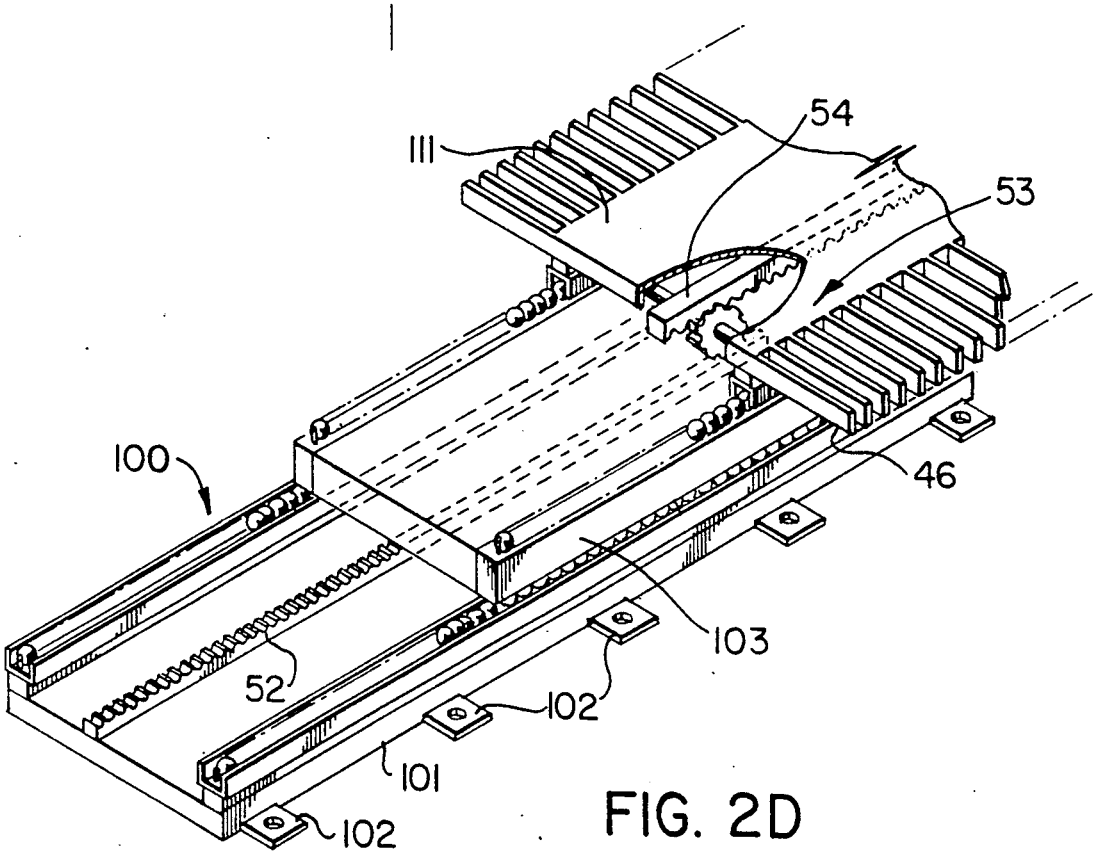
FIG. 2D is a diagrammatic isometric view of a shuttle module in a first embodiment.
Figure 2E:
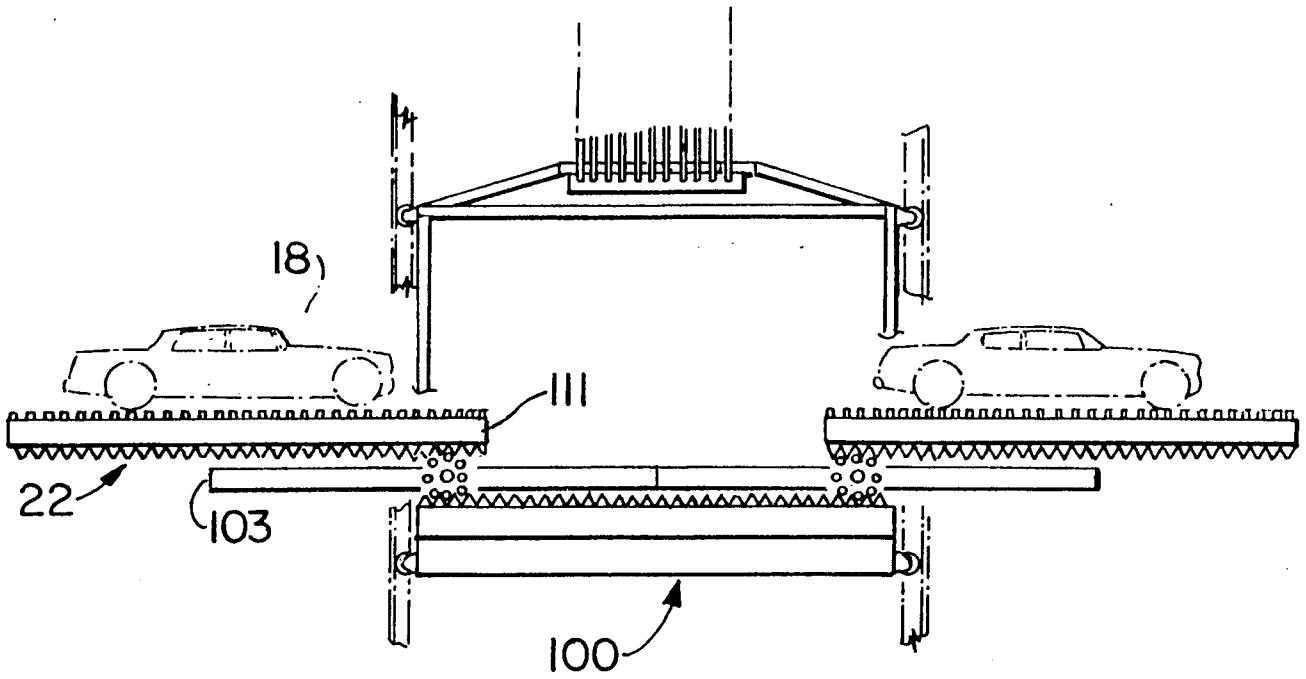
FIG. 2E is a side view of a skip hoist illustrating diagrammatically the storage or parking and retrieval of an automobile on a shuttle according to the first embodiment.
Figure 2F:
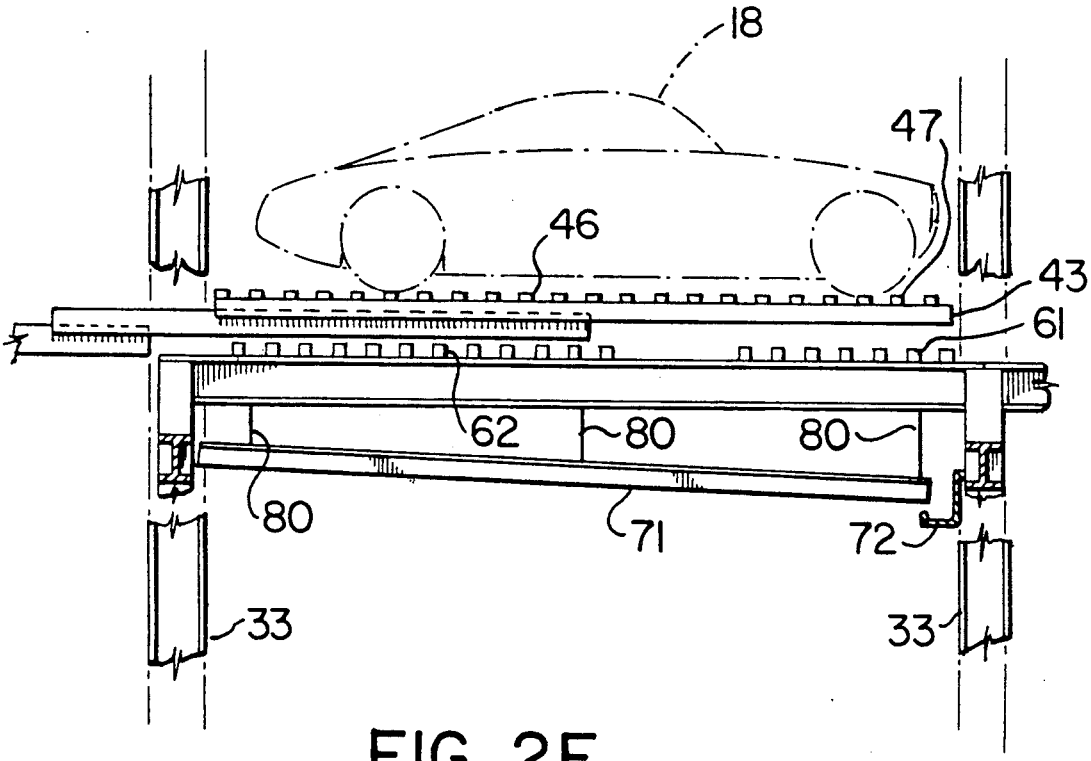
FIG. 2F is a side view of a typical parking slot or vehicle storage module with the shuttle of the skip being in a raised condition and supporting a vehicle to be stored or retrieved.
Figure 2G:
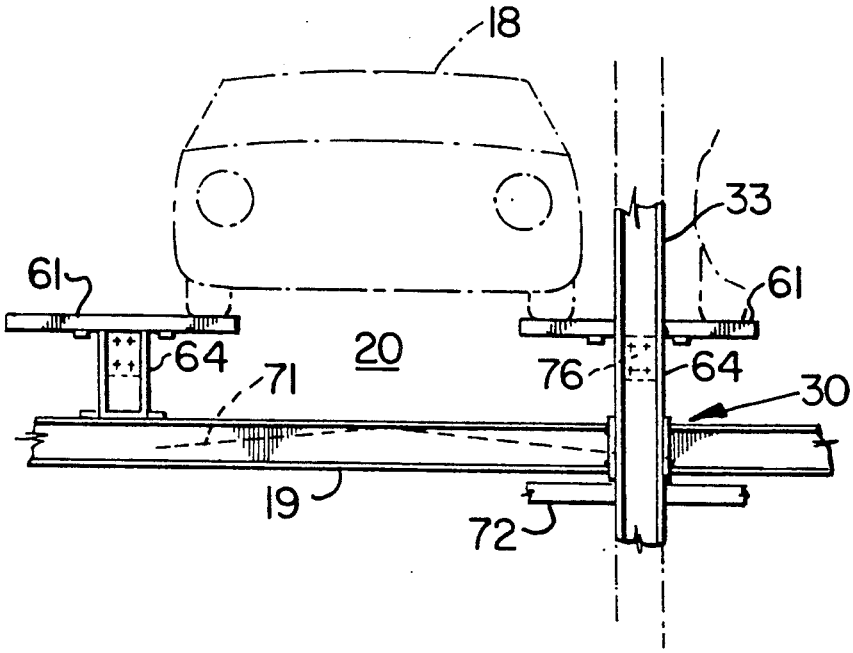
FIG. 2G is front view of the parking slot module of FIG. 2F with the vehicle in its parked or stored position.

The horizontal beams 19 are bolted at a connection location generally shown at 30 to the vertical columns 33 as best seen in FIGS. 2G and 7. The horizontal beams 19 are W12×40 steel beams and extend approximately 10'6" between the vertical columns 33.

The parking slot modules generally illustrated at 20 are connected by bolts both to the columns 33 and to the horizontal beams 19 as seen in FIGS. 2F and 2G. The parking slot modules include two stub beams 64 (FIG. 2G) each bolted to a horizontal beam 19. A W12×40 support I beam 75 connected between the stub beams 64. Likewise, a second horizontal beam 76 is connected with bolts between adjacent columns 33 at the same height to form the other half of the support for the floor fingers 61, 62 (FIGS. 2F and 2G). The beam 75 is desirably approximately 20 feet long between adjacent columns 33.

The floor fingers 61, 62 are mounted apart such that a series of slots or spaces exist between the fingers 61, 62 which are thereby mounted in a spaced relationship on the horizontal beams 75, 76 such that the cooperating fingers 46, 47 (FIG. 2F) of the upper slide 43 of the shuttle 22 can slip therethrough when the upper slide 43 is lowered.

A drip tray 71 is mounted below the parking slot module 20 to the beams 75, 76 (FIGS. 2F and 2G). It is connected to the beams 75, 76 by ⅜" galvanized hanger rods 80 and slants as illustrated to a gutter 72 hung from columns 33. Gutter 72 is connected between the columns 33 and acts to catch the drainage from the drip tray 71.

Figure 4:
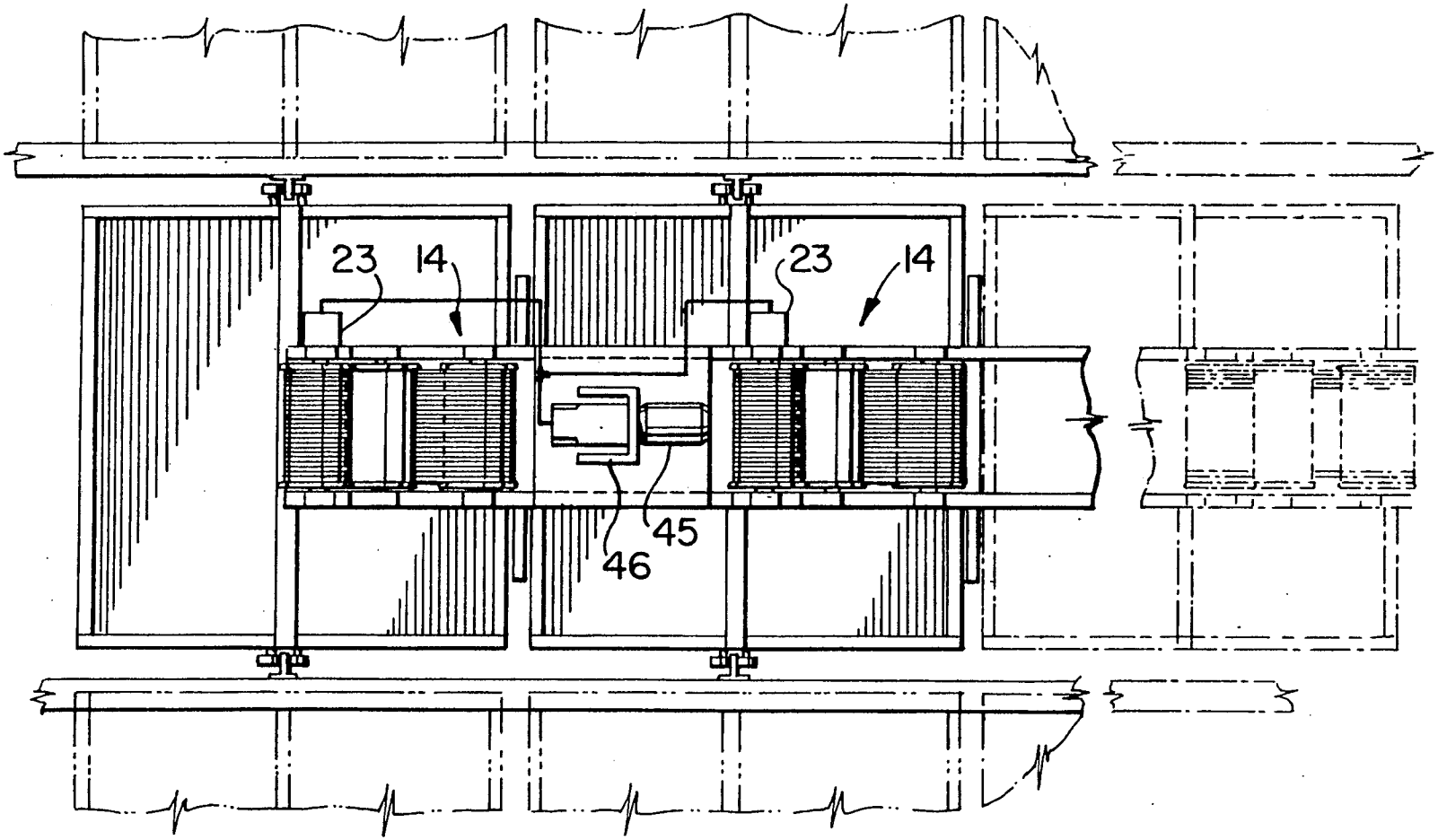
FIG. 4 is a plan view of the drive hoist module taken along IV—IV of FIG. 3.

The skip or drive hoist modules 14 (FIGS. 3 and 7) are detachably connected to the structure 10 and include the skip hoist machinery which is used to raise and lower the skip 13. The machinery includes the traction or drive drums 23 and the bend sheaves 24 as illustrated in FIGS. 3, 4 and 7 around which the twelve line wire rope cables 27 pass. One drive hoist module 14 is used for each skip 13. In addition to the traction and bend sheaves 23, 24, the module includes the counterweight equalizing drums 39 in the FIG. 7 embodiment when two counterweights 31 are preferably used and six of the twelve wire rope cables are connected to each counterweight 31. The counterweights 31 move within counterweight guides 35 (FIG. 7) by means of nylon rollers (not shown) connected to the top and bottom on both sides of the counterweight 31. It also includes primary and secondary braking devices, coding devices to determine the level of each skip and safety devices such as overspeed or underspeed sensors. Such devices are generally known to those skilled in the art and are not illustrated.

The hydraulic power unit module 17 is detachably mounted on the drive hoist module 14. The hydraulic power unit module 17 comprises an electric motor 45 coupled to a variable displacement hydraulic pump 46 (FIGS. 3 and 4). The power unit module 17 is used to drive two traction drives 23 although it could be used to drive more, if desired.

Figures 9A, 9B, 9C:
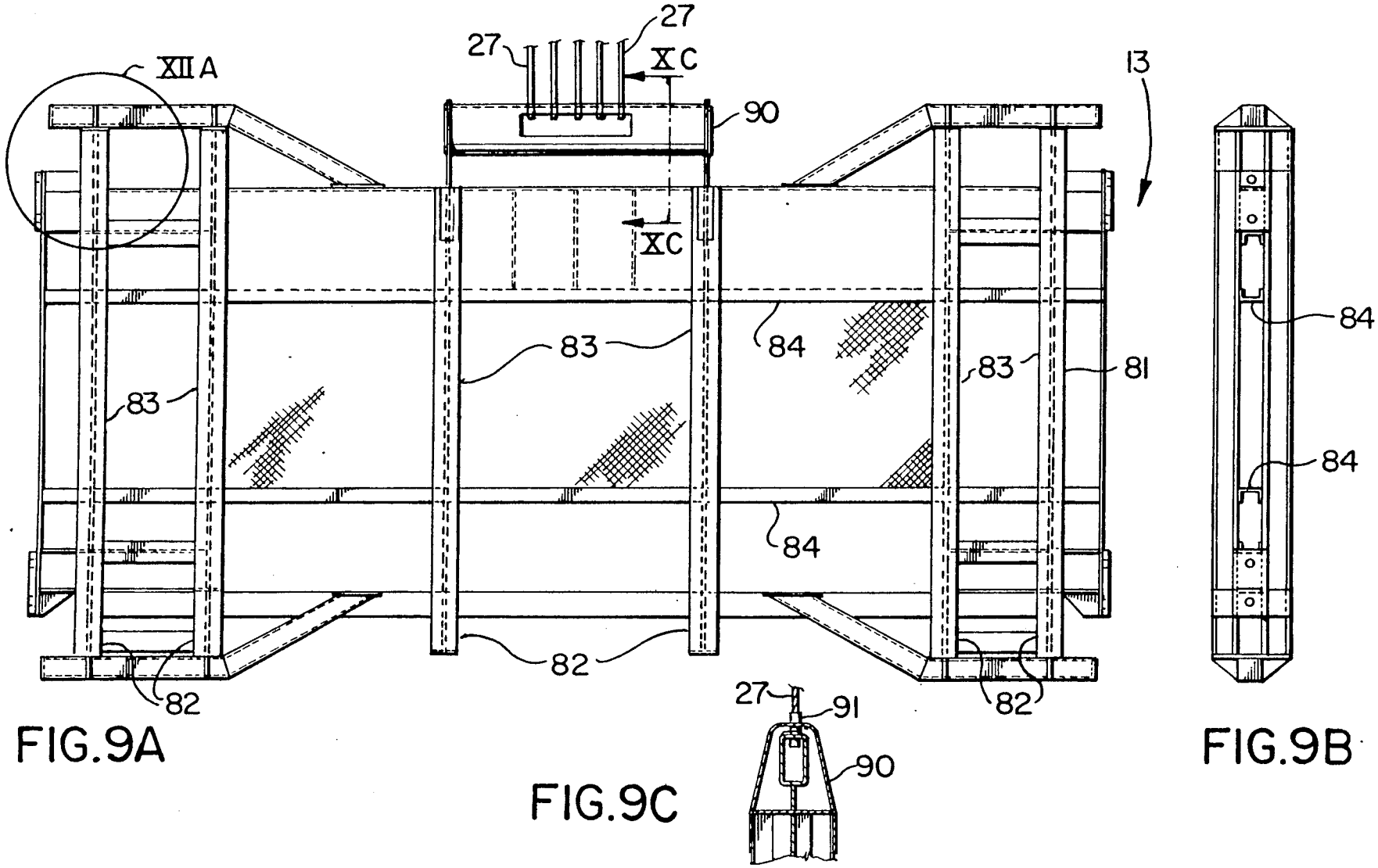
FIG. 9A is a side view of a second embodiment of a skip.
FIG. 9B is a front view of the skip of FIG. 9A particularly showing the web stiffeners.
FIG. 9C is a sectional view taken along XC—XC of FIG. 9A.
Figures 10A, 10B:
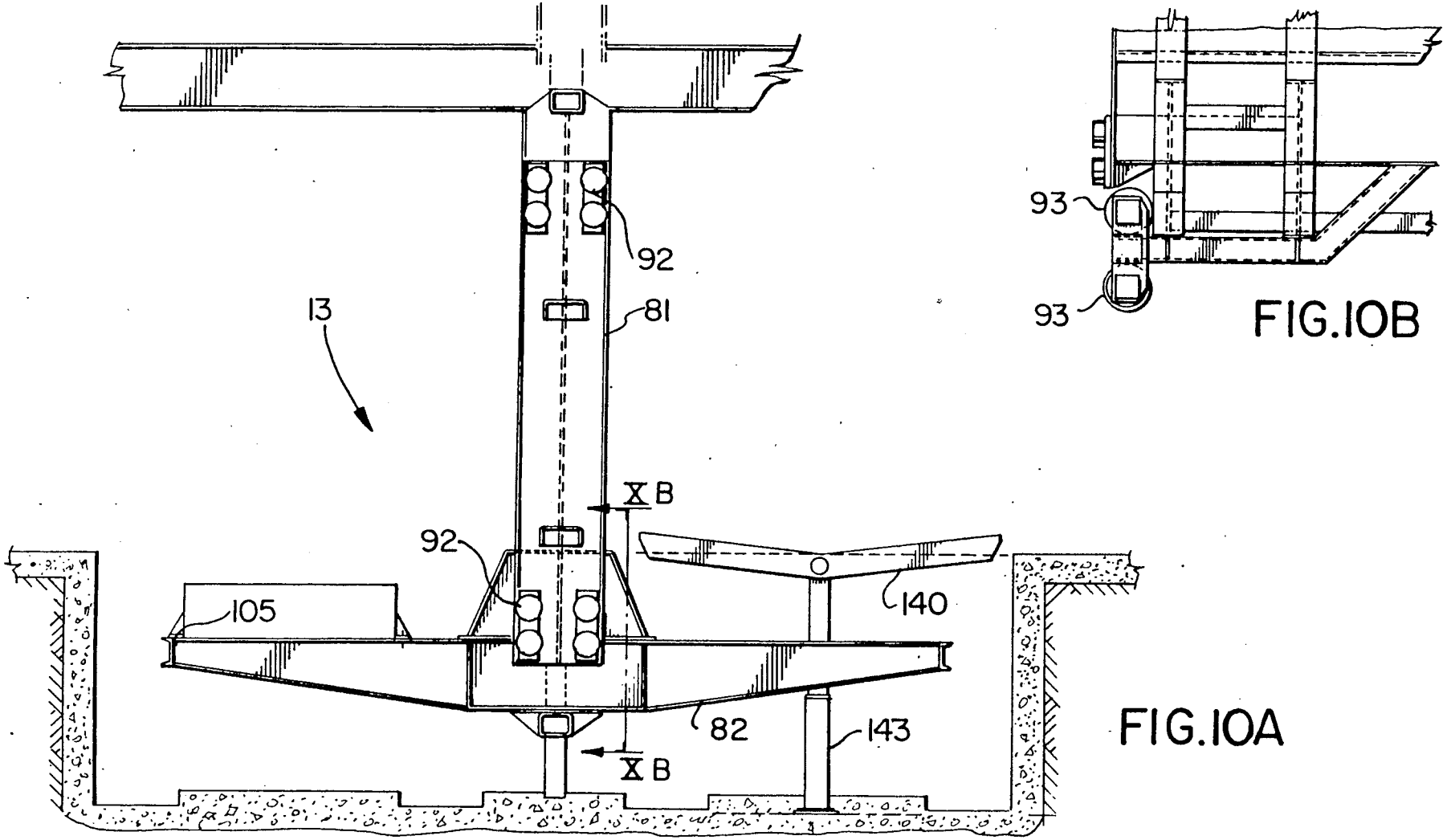
FIG. 10A is a front view of the skip hoist of FIG. 9.
FIG. 10B is a sectional view taken along XIB—XIB of FIG. 10A.
Figure 11:
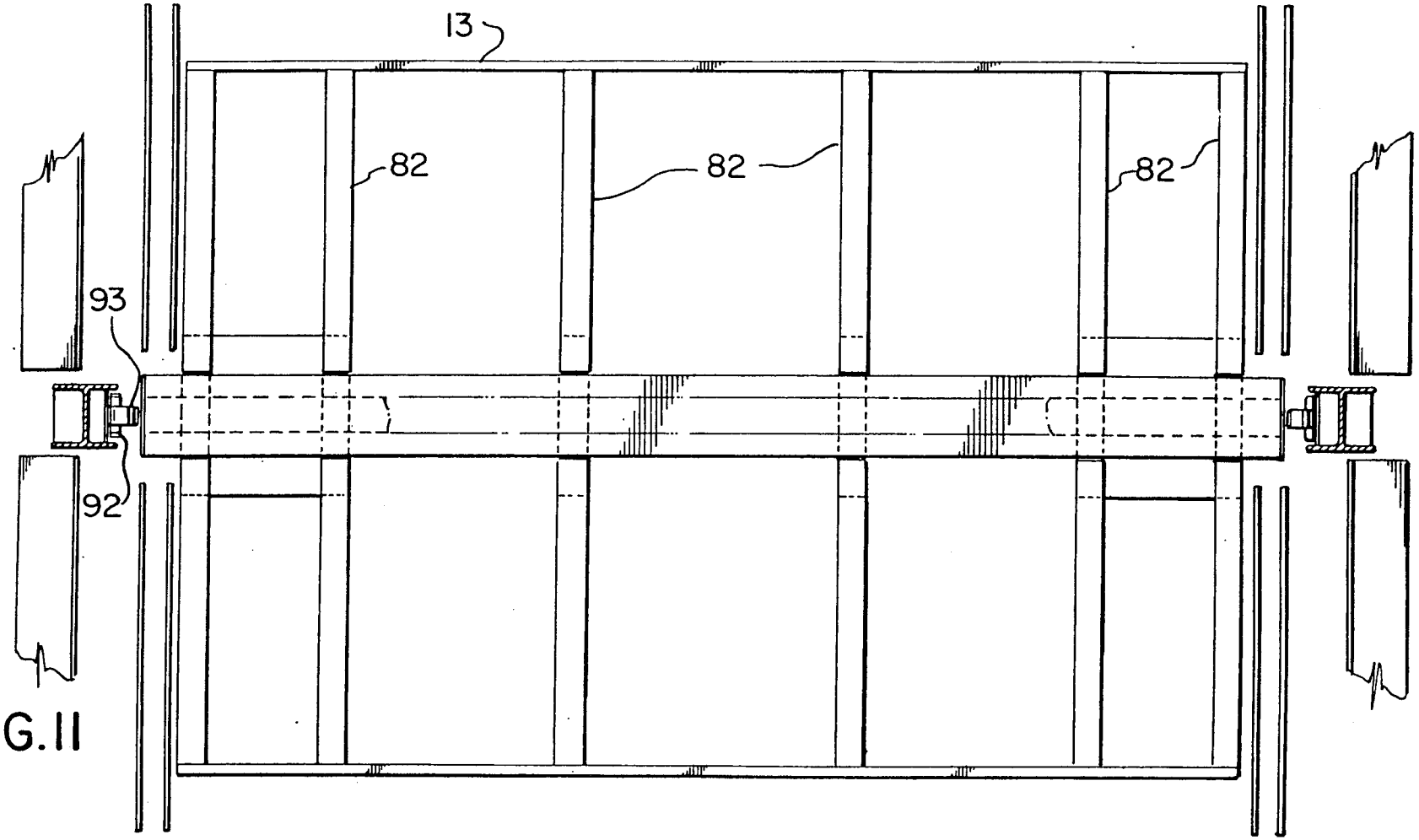
FIG. 11 is a diagrammatic plan view of the skip hoist of FIG. 9.

The skip 13 is shown more clearly in FIGS. 9, 10 and 11. It comprises a longitudinal centre girder 81 made from an aluminum I beam which extends the length of the skip 13 as seen in FIGS. 9 and 10. Six aluminum bottom girders 82 are connected transversely to the centre girder 81 as best seen in FIG. 9A.

The skip 13 further comprises a series of aluminum strengthening girders 83 mounted vertically on the I beam or centre girder 81 at six locations as viewed in FIG. 9A. Four aluminum web stiffeners 84, two mounted on each side of the web of the I beam girder 81, are used for strengthening the longitudinal I beam 81.

A traction wire rope fastener bar 90 is welded to the top of centre girder 81. It is used to connect the wire rope cables 27 to the skip 13 through a spelter socket 91 as seen in FIG. 9C. The skip 13 is connected to twelve line traction ropes 27 which extend from the bar 90 of the skip 13 to the counterweight equalizing drums 39 where they are divided with six cables 27 extending to each counterweight 31 as described.

Figure 12A:
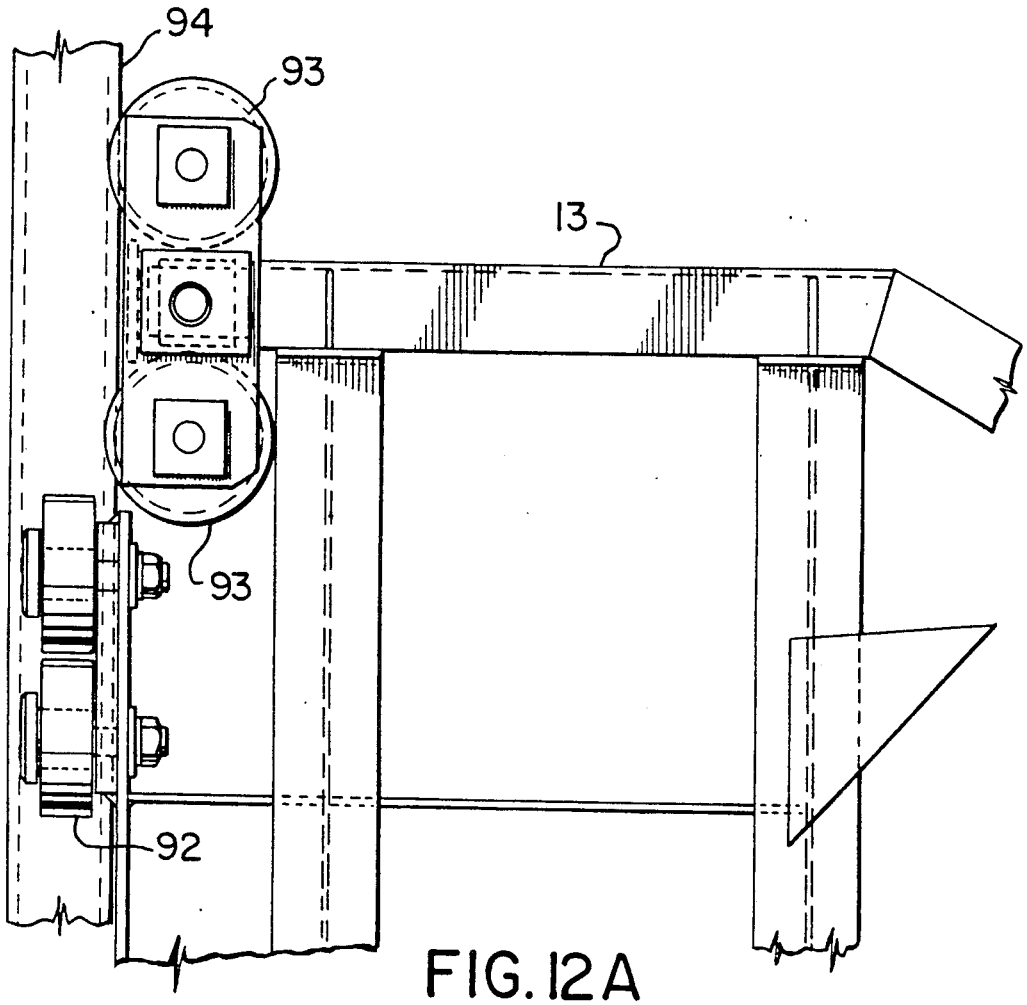
FIG. 12A is an enlarged view of the area XIII of FIG. 9 but with the running rolls mounted to the skip.
Figure 12B:
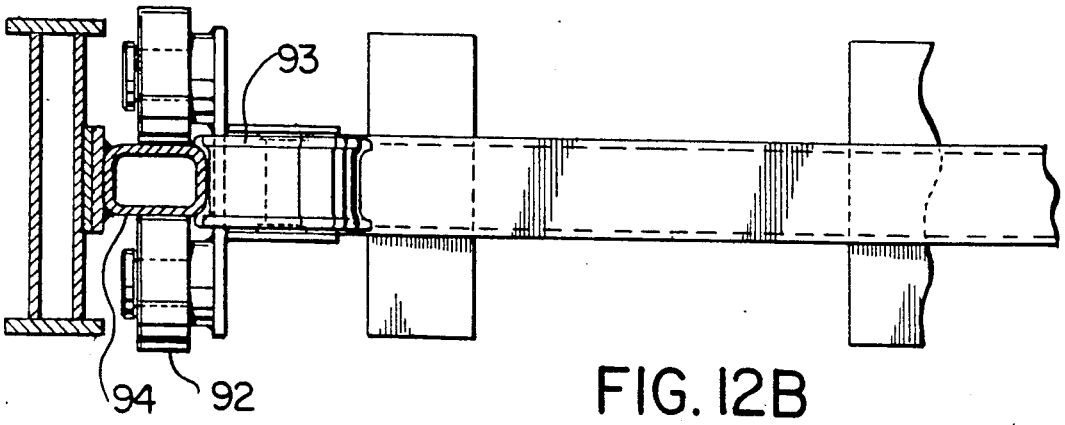
FIG. 12B is a plan view of FIG. 12A.

Lateral and vertical guide rolls 92, 93, respectively, are mounted to the skip 13 as best seen in FIGS. 12A and 12B. The vertical guide rolls 92 move on the outside of the skip guide 94 while the lateral guide rolls 92 act to sandwich the skip guide 94 therebetween. There are four sets of vertical guide rolls 93, one set being located on both the top and bottom of each side of the girder 81 as best seen in FIGS. 10B and 12B. Each set includes two rolls 93.

Likewise, there are four sets of lateral guide rolls 92, four rolls being in each set and mounted at the top and bottom of the girder 81 on each end of the skip 13. The skip guides 94 are mounted to the vertical columns 33 as seen in FIG. 6.

Figure 13A:
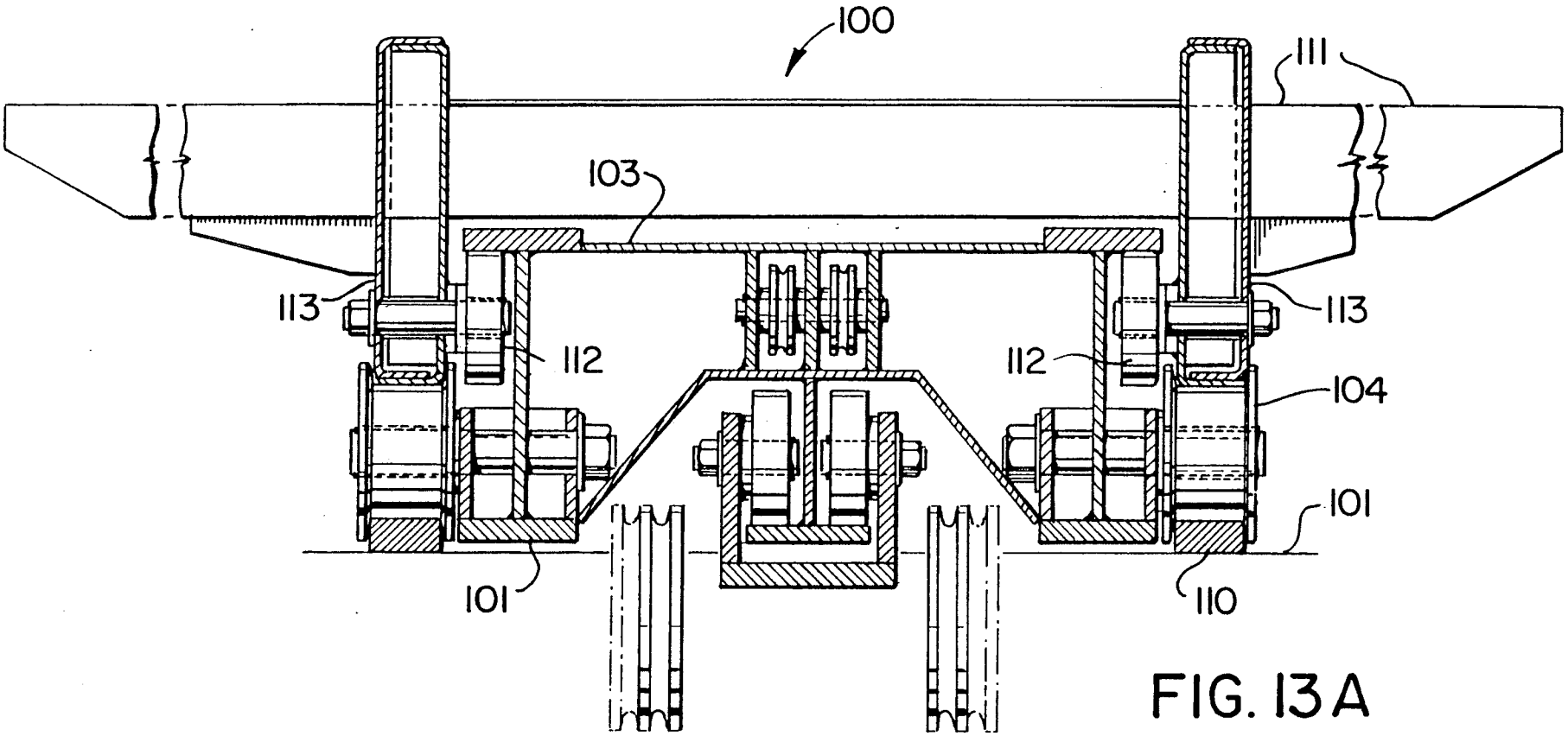
FIG. 13B illustrates diagrammatically the operation of the shuttle in the second embodiment.

The shuttle module is generally illustrated at 100 in FIG. 13A and is illustrated diagrammatically in FIG. 13A. It comprises a base 101 which is fastened to the skip 13 through connector brackets 102 (FIG. 2D) which are mounted on each side of the base 101. The connector brackets 102 are intended to mate with the bottom girders 82 and are bolted to the girders 82 through holes 105 (FIG. 10A) such that the base 101 is fixed relative to the skip 13.

A middle slide 103 is mounted on the base 101 and is adapted to move relative to the base 101. A series of rollers 104 are connected to the middle slide 103 and move on tracks 110 connected to the base 101. An upper slide 111 is mounted on the middle slide 103 and a series of rollers 112 are connected to a roller holding bracket 113 which moves within the rollers 104 connected to the middle slide 103 as seen in FIG. 13A.

The middle slide 103 and the upper slide 111 are intended to move relative to the base 101 and to each other. In addition, the upper slide 111 is intended to move a distance relative to the middle slide 103 which is identical to the distance the middle slide 103 moves relative to the base 101. Thus a telescoping motion is obtained for the shuttle 100 which allows for substantial movement of the vehicle 18 positioned on the skip 13 and graphically seen in FIG. 2E.

In a first embodiment, a fixed cam-pinion rack 52 (FIG. 2D) is mounted on the base 101 and a walking cam-pinion drive 53 is mounted on the moving middle slide 103. A cam-pinion rack 54 is also mounted on and moves with the moving upper slide 111.

Figure 5:
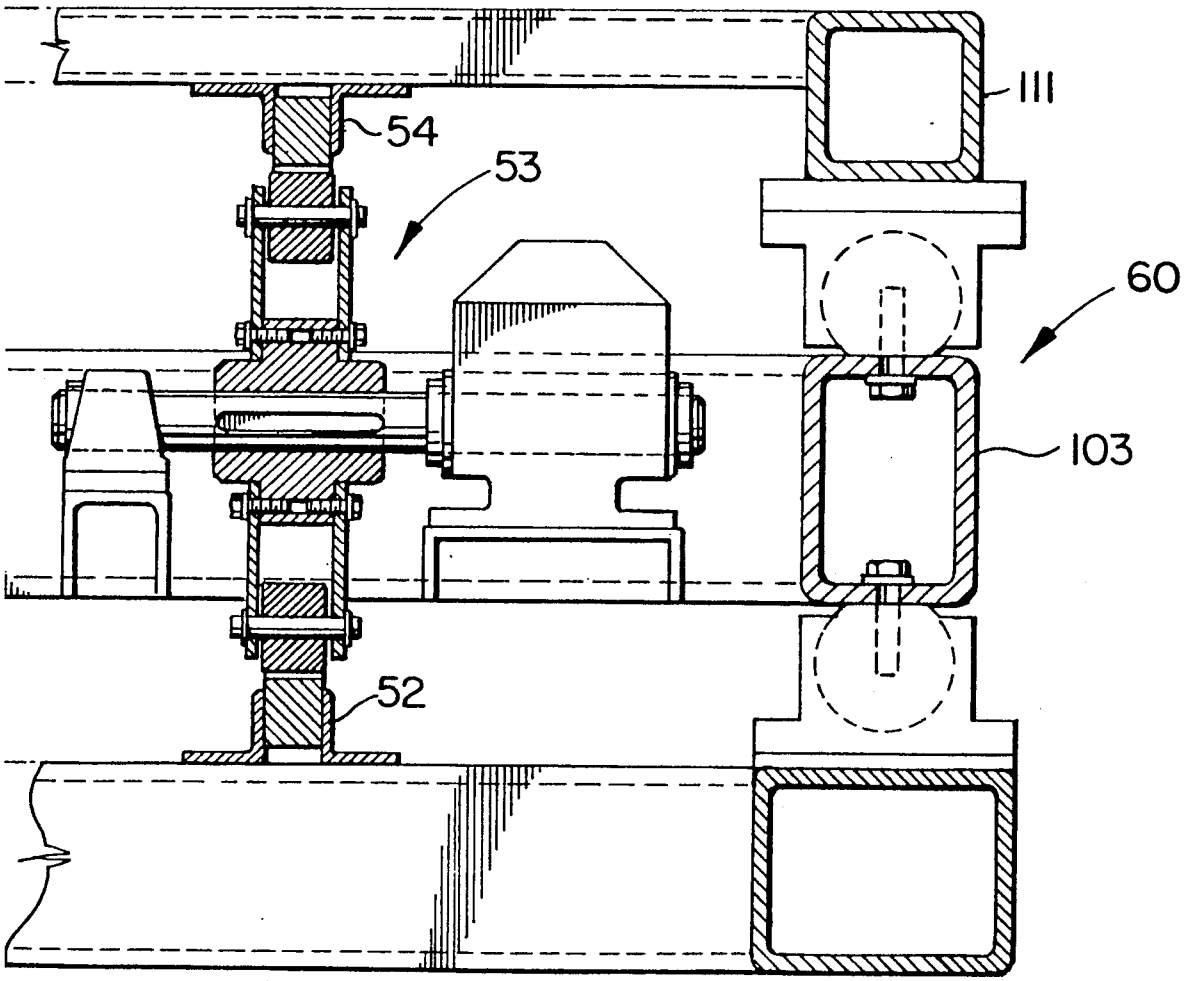
FIG. 5 is a cross sectional view of the first embodiment of the shuttle illustrating the bearing and cam-pinion drive arrangement.

With reference to FIG. 5, a Thompson ball guide arrangement 60 is used with the cam-pinion drive embodiment of the shuttle 100 of FIG. 2D and is mounted between the base 101, the moving middle slide 103 and the upper slide 111. The ball guide bearing arrangement 60 is adapted to allow smooth longitudinal relative movement between each of the base, middle and upper slides 101, 103, 111, respectively, whilst maintaining high cantilever strength.

Figure 13B:
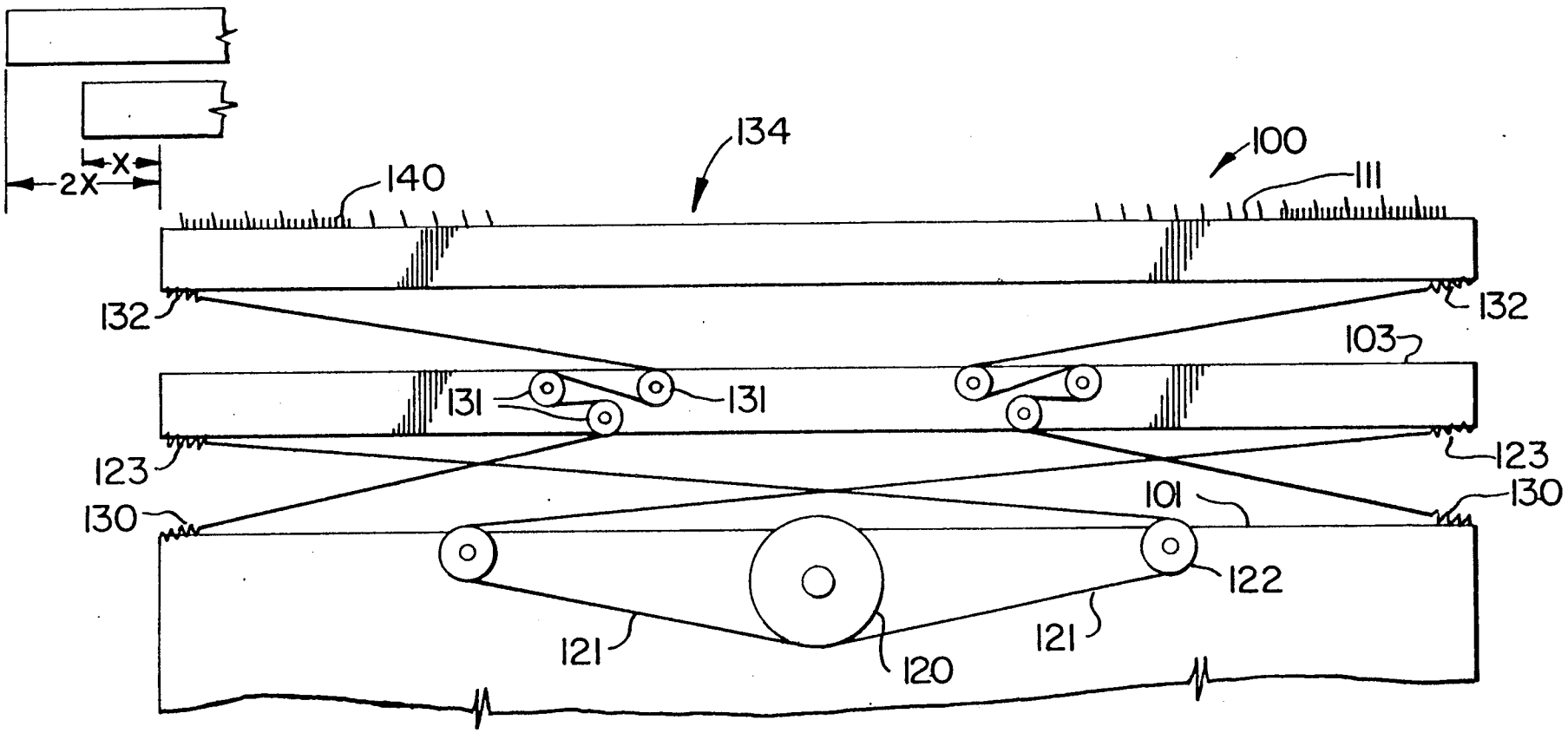

The cam-pinion drive arrangement 53 of FIG. 2D is replaced with the cable drive assembly generally illustrated diagrammatically at 114 in FIG. 13B in a second embodiment. In this embodiment, a motorized gearmotor/brake traction slave drive 120 which is reversible is mounted in the base 101 and remains stationary. Drive cables 121 are connected to the gearmotor 120 and extend over bend sheaves 122 which are connected to the base 101. From the bend sheaves 122, the cables 121 extend to self tensioning devices 123 which are connected between the end of the cables 121 and the middle slide 103.

A further set of cables 124 extend from self tensioning devices 130 on the base 101 around bend sheaves 131 located on the middle slide 103 to self tensioning devices 132 mounted on the upper slide 111. When the vehicle is intended to be stored or retrieved, the gearmotor 120 is activated accordingly to extend or retract the upper and middle slides 111, 103, respectively, relative to the base 101.

Figure 15:
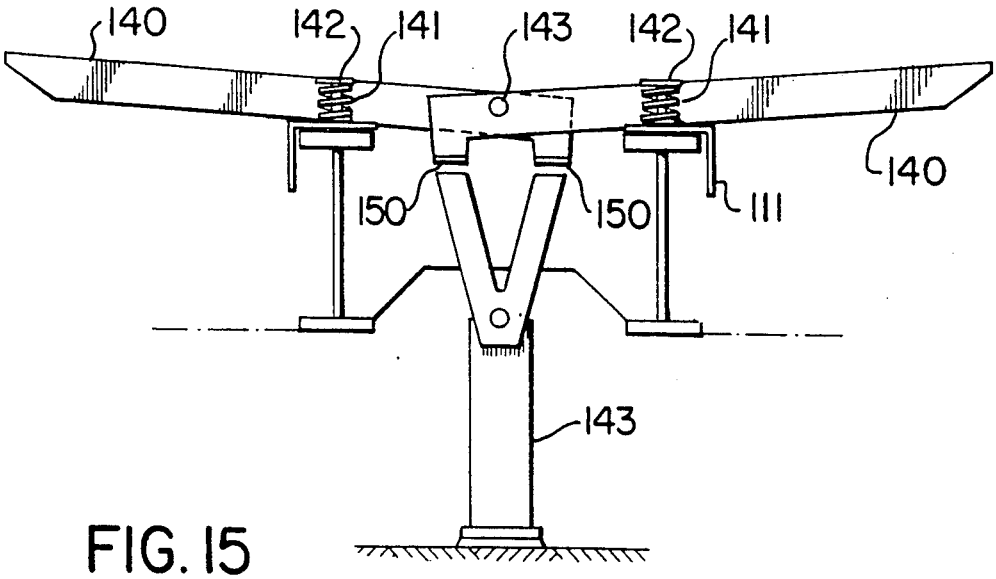
FIG. 15 is a diagrammatic view of the deactivator device and the fingers of the shuttle according to the invention.

The upper slide 111 includes a series of fingers generally illustrated at 134 similar to those fingers 46, 47 illustrated in FIGS. 2D and 2F. The fingers 134 are of two types. The first set 140 of fingers 134 is located at the end of the upper slide 111 which is intended to extend the furtherst from the base 101 and are illustrated in more detail and diagrammatically in FIG. 15. A spring 141 is connected between the upper slide 111 and a washer 142 is mounted to the upper slide 111. The fingers 140 pivot about axis 143 and, when the skip 13 is off the ground level of the structure 10, the fingers 140 will assume the position shown in FIG. 15 under the influence of springs 141. A fixed deactuator 143 is mounted at the ground level of the parking structure 10 and extends upwardly towards the fingers 140 as also seen in FIG. 10A.

When the skip 13 moves downwardly to ground level and reaches the position adjacent the deactuator 143, the deactuator 143 will contact the arm ends 150 of the fingers 140 on opposite sides of the axis 143. This will rotate the fingers 140 to a horizontal position when the skip 13 returns to ground level.

The purpose of the spring mounted fingers 140 is to provide a restraining force on the vehicle 18 both longitudinally and laterally when the vehicle is being carried on the skip 13 and the shuttle upper slide 111.

Operation

In operation and with reference to FIG. 8, an automobile 18 is driven through one of the access ports 16 at the ground level of the parking structure 10 and onto the movable upper slide 111 of the skip 13 which is, of course, at ground level. The operator will leave the automobile 18 under processor or computer control or otherwise.

For example, there may be either dedicated or random parking. For dedicated parking; that is, when the user retains a certain parking location continuously or when the space itself is owned or leased, the vehicle operator can present a computer card to a terminal for system access. On removal of the card, the system will operate automatically to lift the skip 13 and store the vehicle in the appropriate parking slot module 20 with the stored location of the vehicle 18 memorized. When the user returns to retrieve his vehicle, the re-entry of the card will automatically retrieve the owners vehicle to the same access port 16 of the structure 10.

For random parking, the system will operate similarly. However, the terminal will produce a vehicle identification card which is computer coded and delivers the vehicle to an available parking module 20. Upon return of the user to the structure 10, the card is inserted and the vehicle 18 will again be returned to the user automatically and under computer control as has been described. In dedicated parking, the card will be returned to the user after vehicle retrieval but in random parking, the card will be retained by the terminal.

Upon the user leaving the vehicle 18 on skip 13, the proper hydraulic power unit module 17 will provide fluid to the appropriate traction drive 23. The traction sheaves 23 will then turn thus raising the skip 13. The counterweight 31 will move downwardly within the counterweight guides 35 as illustrated in FIG. 7 and the lateral and vertical rolls 92, 93 on the skip 13 will travel within and on the skip guides 94 as previously described.

As the skip 13 rises from the groung level in the shaft 12, the fingers 134 on which the front wheels 154 of the vehicle 18 are positioned will leave contact with the deactivator 143. The fingers 134 will be biased upwardly about axis 142 under the influence of the individual springs 141 acting on each of the fingers 134. Thus, an inwardly directed sidewise force will be exerted on the tires of the vehicle 18 by the fingers 134. As well, since the fingers 134 in front of and behind the tires of the vehicle 18 will be raised, a restraining force on the tires of the vehicle 18 will also exist in a forward and backwards direction. The vehicle 18 will thereby be restrained on the shuttle 100 during movement.

Again, under computer control or otherwise, the skip 13 will be raised until a vacant parking slot module 20 is found on either end of the skip 13. The skip 13 will continue to be raised until the upper slide 111 of the shuttle 100 is above the fingers 62 on the beams 75, 76 of the parking slot module 20.

The middle slide 103 and the upper slide 111 will be extended by initiating rotation of the cam-pinion drive 53 so that the upper slide 111 moves outwardly using the Thompson ball guide arrangement 60 as illustrated more clearly in FIG. 5 or, alternatively, by using the gearmotor 120 of FIG. 13B. In either event, the movable upper slide 111 and the middle slide 103 are extended until the vehicle 18 is in the extended position illustrated in FIG. 2E, it being understood that because the shuttle 100 is bi-directional, access to vacant parking slot modules 20 at either end of the skip 13 is possible. The travel of the upper slide 111 in either direction is a fixed repeatable distance.

When the upper slide 111 is fully extended as illustrated in FIG. 2E, the skip 13 is lowered slightly and the fingers 134 of the upper slide 111 pass through the opposed fingers 61, 62 of the parking module 20 as seen in FIG. 2F. The vehicle 18 is thus deposited on the fingers 61, 62 of the parking slot module 20 and assumes the position shown in broken lines in FIG. 2G.

The cam-pinion drive 53 (FIG. 2D) or gearmotor 120 (FIG. 13B) is then reversed with the result that the upper slide 111 and the middle slide 103 are retracted into their normal unextended positions. The skip 13 then is lowered and returns to ground level where it is ready to transport a second vehicle 18 to another parking slot module 20 or, if required, it may move to another further elevated location to retrieve a vehicle 18 from its parking slot module 20.

It will be noted that the parking structure 10 provides for all moving machinery within the parking structure 10 to be confined to the skip hoist shafts 12 and shuttle module 22. Thus, it is possible to reduce or eliminate maintenance in the parking slot modules 20 and to confine necessary maintenance work principally to the skip hoist shafts 12.

Likewise, it is noted that all connections are bolted connections and that the components, namely the parking slot modules 20, the skip module 13, the shuttle modules 22, the drive hoist modules 14 and the hydraulic power unit modules 17 are easily separated and joined together to form a structure that may be assembled and disassembled with relative ease and also to form a structure 10 of varying capacities depending on the volume of vehicle storage area required which may be dictated by the location and/or parking demand in a particular city area.

The skip 13 may, of course, have one or two bi-directional shuttle modules 22. As well, more than two modules 22 could be used if required for the particular customer as defined by the intended operation of the parking structure 10.

Likewise, while a cam-pinion rack and drive arrangement 53 and a gearmotor arrangement 120 have been described as being advantageous for use with the shuttle 100, it is clear that other arrangements for extending the middle and upper slides of the shuttle 100 could be similarly used.

Many dimensions have been given, both for the parking structure framework and for the structure of the various modules. These dimensions are believed to be suitable but they are given in the interest of conveying a full and complete description of the invention and are not intended in any way to limit its scope.

Furthermore, while the particular embodiment of the invention described relates to a parking structure for vehicles, it is clear that the utility of the structure extends to the storage of items other than automobile vehicles with large dimensions, such as loading ore containers, pleasure boats, tote boxes, baggage bins, food chests and the like. The limits of the system with the dimensions given are approximately 10'-0×1-0'-0×20'-0 and the weight limit on the shuttle 100 should not exceed 4000 Kg.

While specific embodiments of the invention and several modifications thereto have been described, other changes will readily occur to those skilled in the art. Such descriptions, therefore, should be considered illustrative only and not as limiting the scope of the invention which should be construed in accordance with the accompanying claims.

What is claimed is:

1. A hydraulically powered skip hoist system comprising at least two skips, a hydraulic motor for each of said skips, a connection extending between each of said skip and said respective hydraulic motor and a common hydraulic pump connected to said hydraulic motors for driving the motors, wherein each of said skips is vertically movable within a skip hoist shaft, and further comprising a plurality of storage slot modules surrounding said skip hoist shafts, each storage slot module being provided with article support means for supporting an article in the storage slot module and at least one bi-directional shuttle for each skip, said bi-directional shuttle being movable relative to said skip for positioning articles on and removing articles from said storage slot modules, wherein said bi-directional shuttle comprises a base, a middle slide mounted on said base and being movable relative thereto, an upper slide mounted on said middle slide and movable relative thereto, drive means mounted to said base and being operable to move said middle slide relative to said base and said upper slide relative to said base and said middle slide, wherein said article support means and said upper slide of the shuttle are each provided with a plurality of finger which mesh with each other for positioning articles on and removing articles from said article support means and wherein the article support means comprises a pair of article support members located in parallel spaced relationship with respect to each other and wherein said top slide of the shuttle is movable between said pair of article support members during said meshing of the fingers.

2. A hydraulically powered skip hoist system as in claim 1 and further including a drive hoist module for each skip mounted at the upper end of said skip hoist shaft and a power unit module detachably connected to said drive hoist module.

3. A hydraulically powered skip hoist system as in claim 2 wherein said drive hoist module includes a traction drive.

4. A hydraulically powered skip hoist system as in claim 3 wherein said power unit module includes an electric motor and said hydraulic pump, said power unit module being operable to drive at least two of said traction drives.

* * * * *